US006959673B2

(12) United States Patent
Sun

(10) Patent No.: US 6,959,673 B2
(45) Date of Patent: Nov. 1, 2005

(54) ENGINE VALVE ACTUATOR ASSEMBLY WITH DUAL AUTOMATIC REGULATION

(75) Inventor: Zongxuan Sun, Troy, MI (US)

(73) Assignee: General Motors Corporation, Detroit, MI (US)

( * ) Notice: Subject to any disclaimer, the term of this patent is extended or adjusted under 35 U.S.C. 154(b) by 206 days.

(21) Appl. No.: 10/405,966

(22) Filed: Apr. 2, 2003

(65) Prior Publication Data

US 2004/0250781 A1 Dec. 16, 2004

(51) Int. Cl.[7] ..... F01L 9/02

(52) U.S. Cl. ..... 123/90.12; 123/90.15; 123/90.17

(58) Field of Search ..... 123/90.12, 90.15–90.18, 123/90.48–90.59

(56) References Cited

U.S. PATENT DOCUMENTS 4,044,652 A 8/1977 Lewis et al.
4,807,517 A 2/1989 Daeschner
5,421,545 A 6/1995 Schexnayder
5,537,976 A * 7/1996 Hu ..... 123/322
5,546,222 A 8/1996 Plaessmann et al.
5,572,961 A 11/1996 Schechter et al.
5,638,781 A 6/1997 Sturman
5,881,689 A 3/1999 Hochholzer
6,109,284 A 8/2000 Johnson et al.
6,263,842 B1 7/2001 DeOjeda et al.
6,321,703 B1 * 11/2001 Diehl et al. ..... 123/90.12
6,374,784 B1 4/2002 Tischer et al.
6,505,584 B2 1/2003 Lou

* cited by examiner

*Primary Examiner*—Thomas Denion
*Assistant Examiner*—Jaime Corrigan
(74) *Attorney, Agent, or Firm*—Kathryan A. Marra

(57) ABSTRACT

A valve actuator assembly for an engine includes a movable engine valve, a movable first spool valve, and a movable second spool valve. The valve actuator assembly also includes an intermediate channel interconnecting the first spool valve and the second spool valve, and a driving channel, a first feedback channel, and a second feedback channel interconnecting the second spool valve and the engine valve. The valve actuator assembly includes an actuator operatively cooperating with the first spool valve to position the first spool valve to prevent and allow high pressure fluid flow to the second spool valve and the driving channel to position the engine valve. The valve actuator assembly further includes a first on/off valve and a second on/off valve in fluid communication with the first feedback channel and the second feedback channel to enable and disable the first feedback channel and the second feedback channel, whereby the first on/off valve and the second on/off valve control motion of the second spool valve.

24 Claims, 4 Drawing Sheets

ENGINE VALVE ACTUATOR ASSEMBLY WITH DUAL AUTOMATIC REGULATION

TECHNICAL FIELD

The present invention relates generally to intake or exhaust valve actuators for engines and, more particularly, to a valve actuator assembly with dual automatic regulation for an internal combustion engine.

BACKGROUND OF THE INVENTION

It is known to provide a valve train or valve actuator assembly for an engine such as an internal combustion engine of a vehicle such as a motor vehicle. Typically, the valve train includes one or more valves, a cam shaft having at one or more cams, and a tappet contacting each cam and valve. Typically, engine valve actuation is accomplished via the engine-driven camshaft. However, this type of valve actuation introduces constraints on valve operation that preclude optimal valve opening and closing schedules, compromising engine performance, fuel economy, and emissions.

It is also known to provide a camless valve train for an internal combustion engine. An example of such a camless valve train is disclosed in the prior art. For example, a camless intake/exhaust valve for an internal combustion engine is controlled by a solenoid actuated fluid control valve. The control valve has a pair of solenoids that move a spool. The solenoids are digitally latched by short digital pulses provided by a microcontroller.

One disadvantage of some camless valve trains is their poor controllability due to open loop instability, which causes great difficulty in their operation. Another disadvantage of some camless valve trains is that they do not provide full capability for variable lift. Further disadvantages of some camless valve trains are that they have relatively high cost, large size, high energy consumption, low repeatability from cycle to cycle and cylinder to cylinder, hard seating impact, and high seating velocity induced noise.

As a result, it is desirable to provide a valve actuator assembly for an engine that improves controllability. It is also desirable to provide a valve actuator assembly for an engine having more flexibility and full capacity for variable lift. It is further desirable to provide a valve actuator assembly for an engine that reduces energy consumption and provides satisfactory seating velocity. Therefore, there is a need in the art to provide a valve actuator assembly for an engine that meets these desires.

SUMMARY OF THE INVENTION

It is, therefore, one object of the present invention to provide a new camless valve actuator assembly for an engine.

It is another object of the present invention to provide a valve actuator assembly for an engine that has dual automatic regulation for controllability.

To achieve the foregoing objects, the present invention is a valve actuator assembly for an engine. The valve actuator assembly includes a movable engine valve, a movable first spool valve, and a movable second spool valve. The valve actuator assembly also includes a driving channel interconnecting the second spool valve and the engine valve, an intermediate channel interconnecting the first spool valve and the second spool valve, and two feedback channels interconnecting the second spool valve and the engine valve. The valve actuator assembly includes an actuator operatively cooperating with the first spool valve to position the first spool valve to prevent and allow fluid flow in and out of the second spool valve and the driving channel to position the engine valve. The valve actuator assembly further includes a first on/off valve in fluid communication with the first feedback channel to enable and disable the first feedback channel to control motion of the second spool valve. The valve actuator assembly also includes a second on/off valve in fluid communication with the second feedback channel to enable and disable the second feedback channel, whereby the first on/off valve and the second on/off valve control motion of the second spool valve.

One advantage of the present invention is that a valve actuator assembly is provided for an engine that has dual hydraulic feedback for precise motion by self-regulating flow control. Another advantage of the present invention is that the valve actuator assembly has controllability that is open loop stable with dual automatic regulation. Yet another advantage of the present invention is that the valve actuator assembly is an enabler for improved valve train stability without sacrificing dynamic performance. Still another advantage of the present invention is that the valve actuator assembly is an enabler for improved engine performance, improved engine fuel economy by lowering fuel consumption, and improved engine emissions by lowering emissions. A further advantage of the present invention is that the valve actuator assembly minimizes energy consumption by self-regulation flow control, simple spool valves, and efficient valve control to minimize throttling of the fluid flow. Yet a further advantage of the present invention is that the valve actuator assembly has uses one solenoid, two on/off valves, and two spool valves. Still a further advantage of the present invention is that the valve actuator assembly has a relatively small size and is easy to package in an engine. Another advantage of the present invention is that the valve actuator assembly has a relatively low cost. Yet another advantage of the present invention is that the valve actuator assembly has improved output torque and built-in soft landing capability to reduce noise and improve durability. A further advantage of the present invention is that the valve actuator assembly provides both precise lift control and soft landing capability by using the dual hydraulic feedback. Still a further advantage of the present invention is that the valve actuator assembly allows independent control over the first and second spool valves for improved dynamic performance.

Other objects, features, and advantages of the present invention will be readily appreciated, as the same becomes better understood, after reading the subsequent description taken in conjunction with the accompanying drawings.

DESCRIPTION OF THE PREFERRED EMBODIMENT

Figure 1:
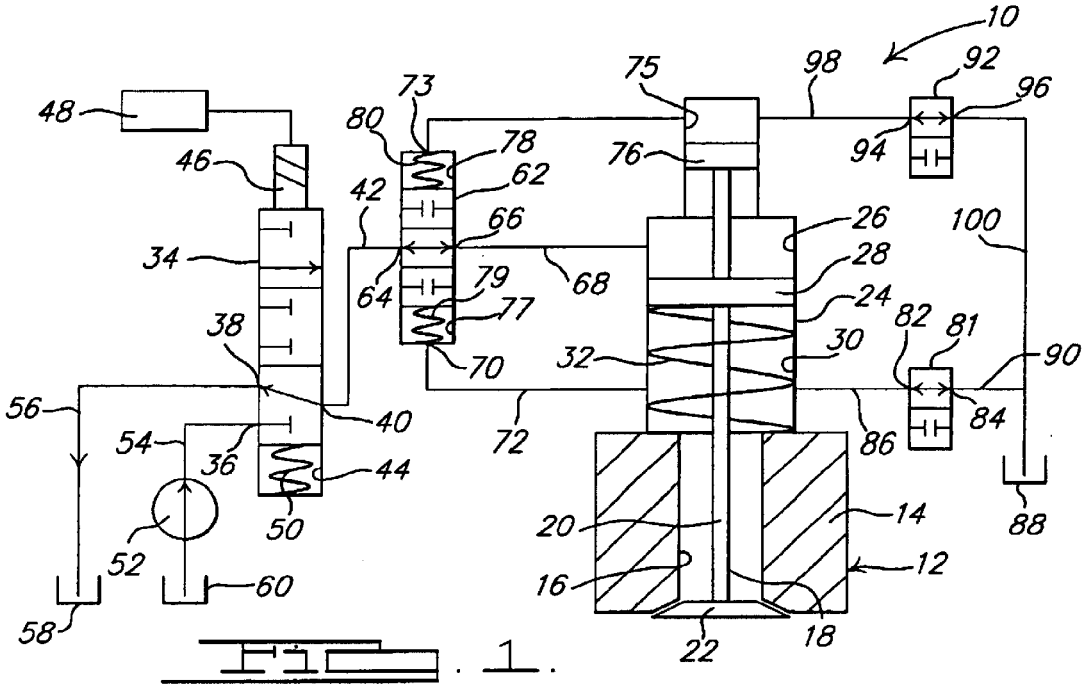
FIG. 1 is a diagrammatic view of a valve actuator assembly, according to the present invention, illustrated in operational relationship with an engine of a vehicle.
Figure 2:
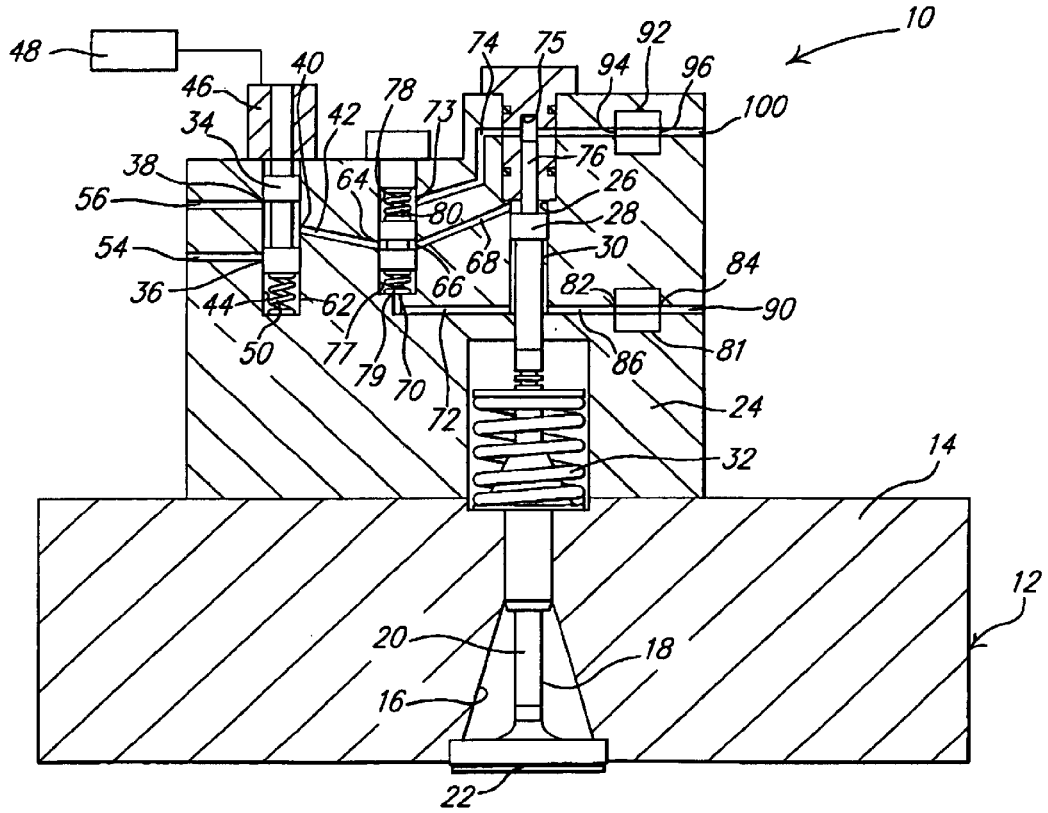
FIG. 2 is a fragmentary view of the valve actuator assembly of FIG. 1 in an engine valve closed position.
Figure 3:
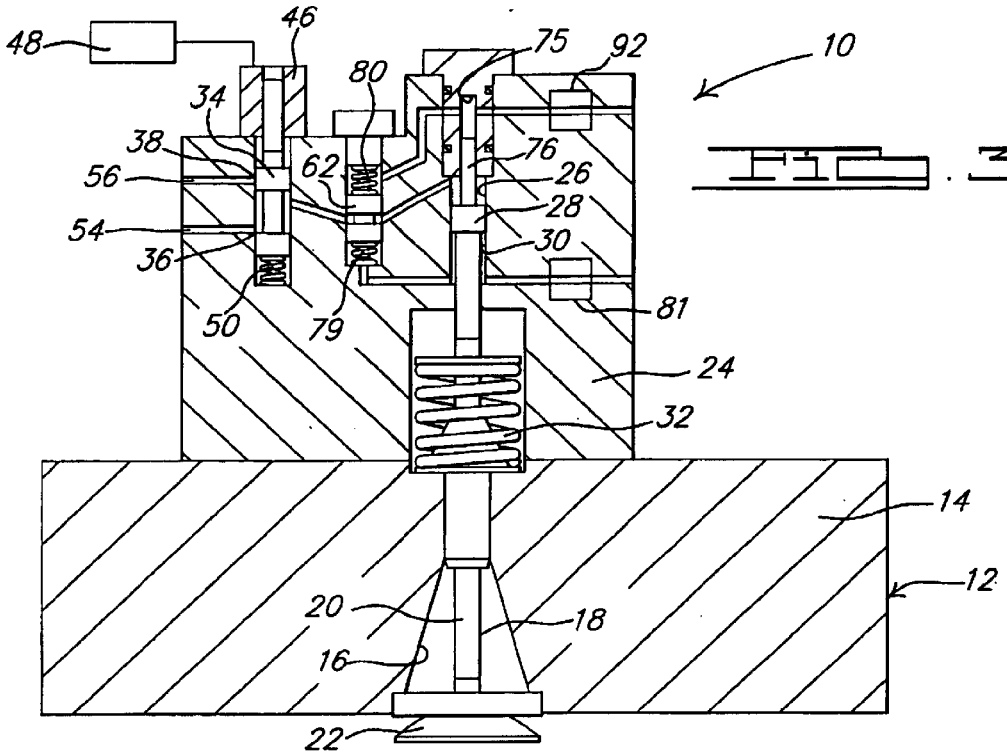
FIG. 3 is a view similar to FIG. 2 illustrating the valve actuator assembly in an engine valve opening position.
Figure 4:
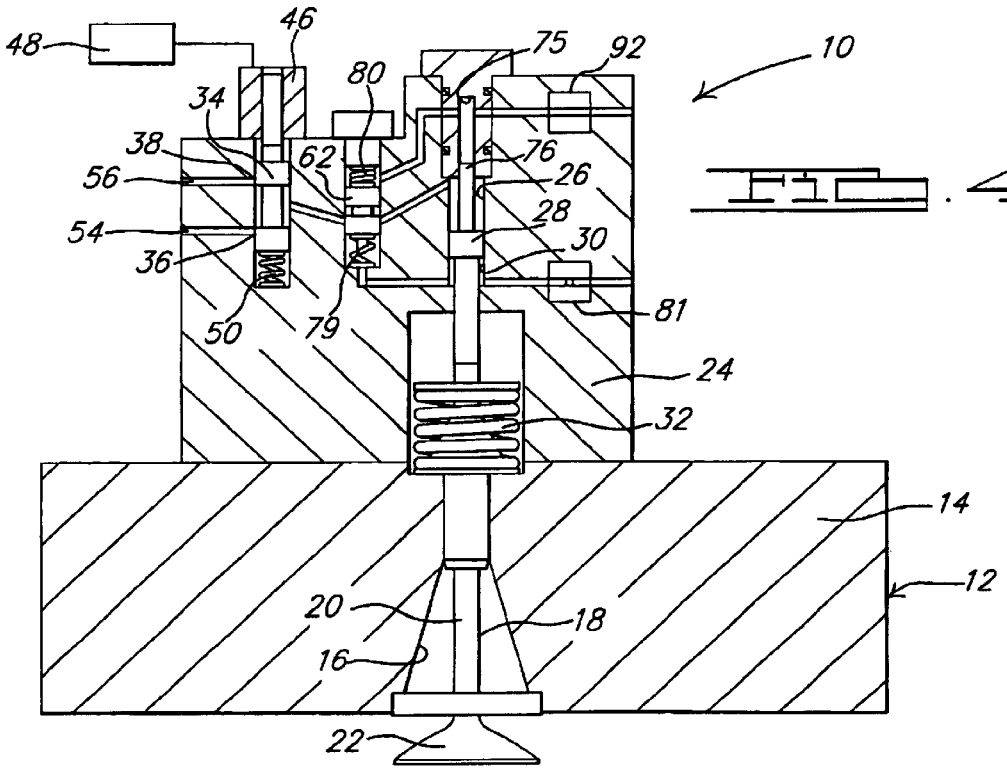
FIG. 4 is a view similar to FIG. 2 illustrating the valve actuator assembly in an engine valve fully opened position.

Referring to the drawings and in particular FIG. 1, one embodiment of a valve actuator assembly 10, according to the present invention, is shown for an engine, generally indicated at 12, of a vehicle (not shown). The engine 12 is of an internal combustion type. The engine 12 includes an engine block 14 having at least one opening 16 therein in communication with at least one internal combustion chamber (not shown). The engine 12 also includes a movable engine valve 18 for each opening 16. The engine valve 18 has a valve stem 20 and a valve head 22 at one end of the valve stem 20. The engine valve 18 is movable to open and close its respective opening 16 between an open position as illustrated in FIGS. 3 and 4 and a closed position as illustrated in FIG. 2. It should be appreciated that the engine valve 18 may be either an intake or exhaust valve. It should also be appreciated that the valve actuator assembly 10 is a camless valve train for the engine 12. It should further be appreciated that, except for the valve actuator assembly 10, the engine 12 is conventional and known in the art.

The valve actuator assembly 10 includes a valve housing 24 disposed adjacent the engine block 14. The valve housing 24 has a main or first fluid chamber 26 therein. The valve actuator assembly 10 also includes a first piston 28 connected to or in contact with the valve stem 20 of the engine valve 18. The piston 28 is disposed in the first fluid chamber 26 of the valve housing 24 and forms a second fluid chamber 30 therein. The valve actuator assembly 10 includes an engine valve spring 32 disposed about the valve stem 20 and contacting the engine block 14 to bias the engine valve 18 toward the closed position of FIG. 2. It should be appreciated that the valve head 22 closes the opening 16 when the engine valve 18 is in the closed position.

The valve actuator assembly 10 also includes a first spool valve 34 fluidly connected to the first fluid chamber 26 of the valve housing 24. The first spool valve 34 is of a three-position three-way type. The first spool valve 34 has a high pressure port 36 and a low pressure port 38. The first spool valve 34 also has a first fluid chamber port 40 fluidly connected by an intermediate channel 42 to a second spool valve 62 to be described. The first spool valve 34 also has a chamber 44 at one end thereof. It should be appreciated that the first spool valve 34 controls fluid flow to the second spool valve 62.

The valve actuator assembly 10 includes an actuator 46 at one end of the first spool valve 34 opposite the chamber 44. The actuator 46 is of a linear type such as a solenoid electrically connected to a source of electrical power such as a controller 48. The valve actuator assembly 10 further includes a first spool valve spring 50 disposed in the chamber 44 to bias the first spool valve 34 toward the actuator 46. It should be appreciated that the controller 48 energizes and de-energizes the actuator 46 to move the first spool valve 34.

The valve actuator assembly 10 also includes a fluid pump 52 and a high pressure line 54 fluidly connected to the fluid pump 52 and the high pressure port 36. The valve actuator assembly 10 includes a fluid tank 58 and a low pressure line 56 fluidly connected to the fluid tank 58 and the low pressure port 38. It should be appreciated that the fluid pump 52 may be fluidly connected to the fluid tank 58 or a separate fluid tank 60.

The valve actuator assembly 10 also includes a second spool valve 62 fluidly connected to the first fluid chamber 26 of the valve housing 24 and the first spool valve 34. The second spool valve 62 is of a three-position two-way type. The second spool valve 62 has a first port 64 fluidly connected by the intermediate channel 42 to the first spool valve 34 and a second port 66 fluidly connected by a driving channel 68 to the primary fluid chamber 26. The second spool valve 62 also has a third port 70 fluidly connected by a first feedback channel 72 to the secondary fluid chamber 30 and a fourth port 73 fluidly connected by a second feedback channel 74 to a third fluid chamber 75 to be described. It should be appreciated that the second spool valve 62 controls fluid flow to the first fluid chamber 26.

The valve actuator assembly 10 includes a third fluid chamber 75 in the valve housing 24. The valve actuator assembly 10 also includes a second piston 76 connected to the first piston 28. The second piston 76 is disposed in the third fluid chamber 75 of the valve housing 24. The valve actuator assembly 10 includes a fourth fluid chamber 77 at one end of the second spool valve 62 fluidly connected to the third port 70. The valve actuator assembly 10 includes a fifth fluid chamber 78 at one end of the second spool valve 62 opposite the fourth fluid chamber 77 fluidly connected to the fourth port 73. It should be appreciated that the spool valves 34,62, chambers 44,77,78, and channels 42,68,72,74 are located in the valve housing 24.

The valve actuator assembly 10 includes a second spool valve spring 79 disposed in the fourth fluid chamber 77 to bias the second spool valve 62 toward the fifth fluid chamber 78. The valve actuator assembly 10 includes a third spool valve spring 80 disposed in the fifth fluid chamber 78 to bias the second spool valve 62 toward the fourth fluid chamber 77. It should be appreciated that fluid pressure in either the fifth fluid chamber 78 that overcomes the force of the second spool valve spring 79 or the fourth fluid chamber 77 that overcomes the force of the third spool valve spring 80 moves the second spool valve 62.

The valve actuator assembly 10 further includes a first on/off digital valve 81 fluidly connected to the second fluid chamber 30 of the valve housing 24. The first on/off valve 81 is of a two-way magnetically latchable type and is electrically connected to a source of electrical power such as the controller 48. The first on/off valve 81 has a first port 82 and a second port 84. The first port 82 is fluidly connected by a channel 86 to the second fluid chamber 30. The valve actuator assembly 10 includes a fluid tank 88 fluidly connected to the second port 84 by a low pressure line 90. It should be appreciated that the fluid tank 88 is a low pressure source.

The valve actuator assembly 10 further includes a second on/off valve 92 fluidly connected to the third fluid chamber 75 of the valve housing 24. The second on/off valve 92 is of a two-way magnetically latchable type and is electrically connected to a source of electrical power such as the controller 48. The second on/off valve 92 has a first port 94 and a second port 96. The first port 94 is fluidly connected by a channel 98 to the third fluid chamber 75. The valve actuator assembly 10 includes the fluid tank 88 fluidly connected to the second port 96 by a low pressure line 100. It should be appreciated that the fluid tank 88 is a low pressure source. It should also be appreciated that the low pressure line 100 may be fluidly connected to the fluid tank 88 or the separate fluid tank (not shown).

In operation of the valve actuator assembly 10, the engine valve 18 is shown in a closed position as illustrated in FIG. 2. At the closed position of the engine valve 18, the actuator 46 is de-energized by the controller 48 so that the first spool valve spring 50 pushes the first spool valve 34 upward and exposes the intermediate channel 42 to the low pressure line 56. The on/off valves 81 and 92 are open so that both the second fluid chamber 30 and the third fluid chamber 75 are exposed to the fluid tank 88. The second spool valve spring 79 and third spool valve spring 80 hold the second spool valve 62 in the centered position and the first fluid chamber 26 is then connected to the low pressure line 56 through the driving channel 68 and the intermediate channel 42. The engine valve spring 32 keeps the engine valve 18 closed with the valve head 22 closing the opening 16.

To open the engine valve 18, the controller 48 energizes the actuator 46 and causes the actuator 46 to overcome the force of the first spool valve spring 50 and drive the first spool valve 34 downward. The intermediate channel 42 is then exposed to the high pressure line 54. The on/off valves 81 and 92 are open so that the second fluid chamber 30 and the third fluid chamber 75 are connected or exposed to the fluid tank 88. The high pressure fluid flows into the first fluid chamber 26 through the driving channel 68, which overcomes the force from the engine valve spring 32 and pushes the engine valve 18 open as illustrated in FIG. 3. It should be appreciated that, in FIG. 3, the engine valve 18 is illustrated in a valve part open position.

To stop the engine valve 18 at a predetermined lift position, the controller 48 energizes the first on/off valve 81 and the first on/off valve 81 is closed, cutting off the fluid connection between the second fluid chamber 30 and the fluid tank 88. As the engine valve 18 continues to move downward, the first piston 28 pushes the fluid in the second fluid chamber 30 via the feedback channel 72 into the fourth fluid chamber 77, which drives the second spool valve 62 upward. This motion continues until the second spool valve 62 cuts off the fluid connection between the driving channel 68 and the intermediate channel 42 and reaches its mechanical stop. When the second spool valve 62 reaches this equilibrium point, the engine valve 18 stops as illustrated in FIG. 4. It should be appreciated that, in FIG. 4, the engine valve 18 is illustrated with the engine valve 18 opened at a desired lift position. It should also be appreciated that the desired lift position is determined by the operation timing of the first on/off valve 81.

Figure 5:
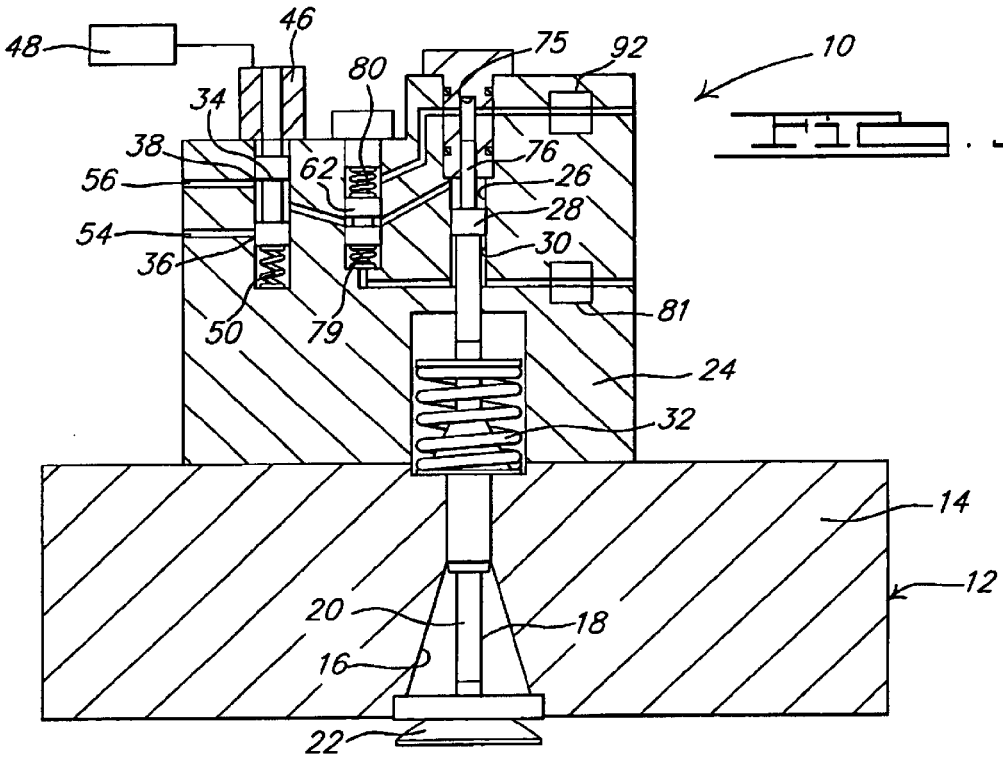
FIG. 5 is a view similar to FIG. 2 illustrating the valve actuator assembly in an engine valve returning position.

To close the engine valve 18, the controller 48 de-energizes the actuator 46. The first spool valve spring 50 then pushes the first spool valve 34 upward and exposes the intermediate channel 42 to the low pressure line 56. The first on/off valve 81 is de-energized so that the second fluid chamber 30 is connected to the fluid tank 88. The second spool valve spring 79 and third spool valve spring 80 will bring the second spool valve 62 back to the center position. The high pressure fluid in the first fluid chamber 26 will exhaust into the low pressure line 56 and return to the fluid tank 58. The engine valve spring 32 drives the engine valve 18 upward as illustrated in FIG. 5. It should be appreciated that the on/off valves 81 and 92 are open so that both the second fluid chamber 30 and the third fluid chamber 75 are connected to the fluid tank 88, causing the low pressure fluid to fill those chambers 30,75 as the engine valve 18 moves upward. It should also be appreciated that the actuator 46 may be of a push/pull type.

Figure 6:
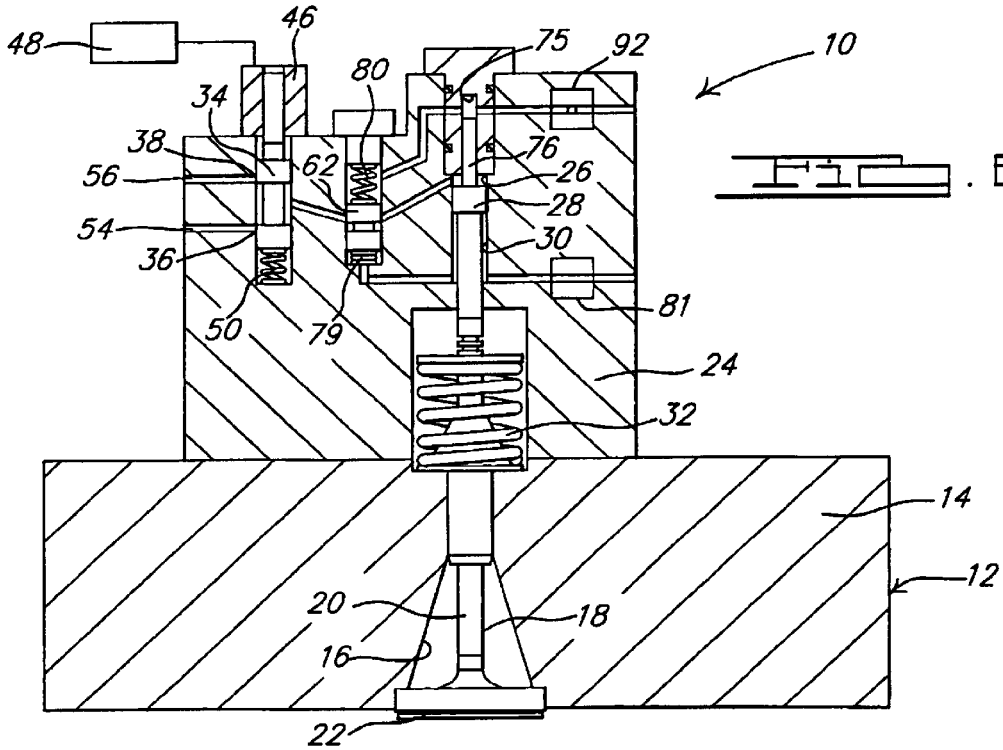
FIG. 6 is a view similar to FIG. 2 illustrating the valve actuator assembly in an engine valve seating position.

To stop the engine valve 18 at a predetermined position while the engine valve 18 is returning to the seated or closed position, the controller 48 energizes the second on/off valve 92 and the second on/off valve 92 is closed, cutting off the fluid connection between the third fluid chamber 75 and the fluid tank 88. As the engine valve 18 moves upward, it displaces the fluid from the third fluid chamber 75 into the fifth fluid chamber 78, driving the second spool valve 62 downward. This motion continues until the second spool valve 62 cuts off the connection between the driving channel 68 and the intermediate channel 42 and reaches its mechanical stop. When the second spool valve 62 reaches this equilibrium point, the engine valve 18 stops as illustrated in FIG. 6. It should be appreciated that, in FIG. 6, the engine valve 18 is illustrated in an engine valve seating position. It should also be appreciated that this feature allows for better control of the impact velocity at seating ("soft landing") of the engine valve 18.

Figure 7:
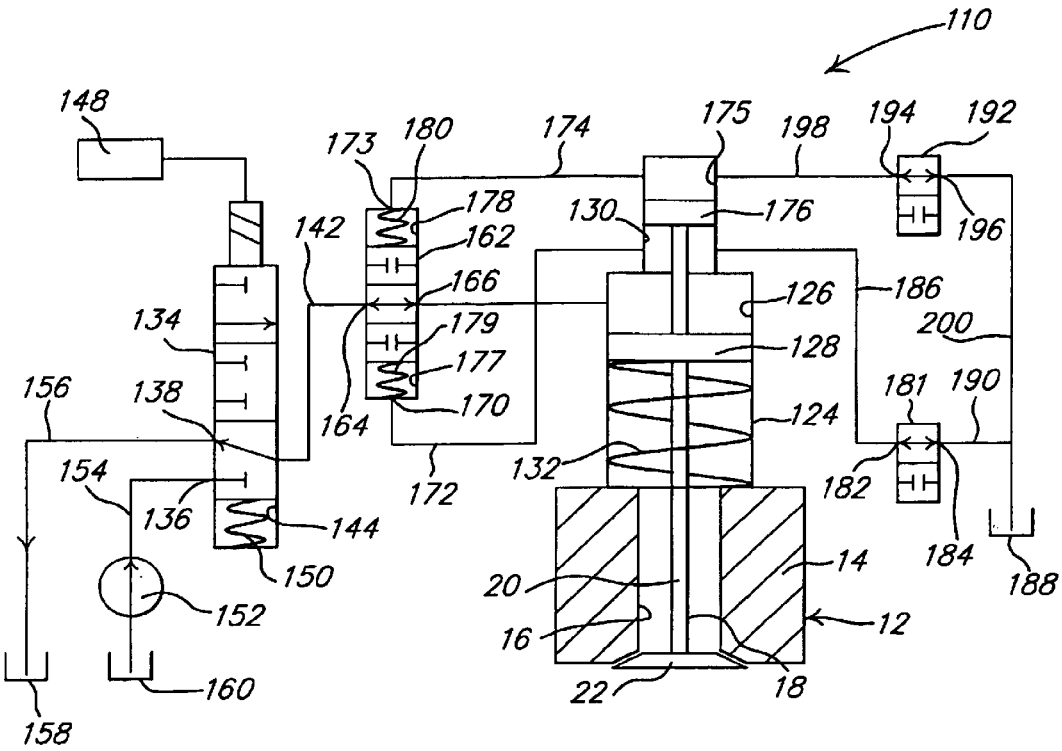
FIG. 7 is a diagrammatic view of another embodiment, according to the present invention, of the valve actuator assembly of FIG. 1.

Referring to FIG. 7, another embodiment, according to the present invention, of the valve actuator assembly 10 is shown. Like parts of the valve actuator assembly 10 have like reference numerals increased by one hundred (100). In this embodiment, the valve actuator assembly 110 includes the engine valve 118, first spool valve 134, actuator 146, controller 148, second spool valve 162, first on/off valve 181, and second on/off valve 192. The second fluid chamber 130 is disposed on the other side of the second piston 176 opposite the third fluid chamber 175. The first feedback channel 172 interconnects the second fluid chamber 130 and the fourth fluid chamber 177. The channel 186 interconnects the second fluid chamber 130 and the first on/off valve 181. The operation of the valve actuator assembly 110 is similar to the valve actuator assembly 10.

The valve actuator assembly 10 of the present invention is made open-loop stable by utilizing the hydraulic feedback channels 72 and 74 and the on/off valves 81 and 92 are used to enable or disable the feedback channels 72 and 74, respectively. Open-loop stability implies that a system's response to a given input signal is not unbounded. The better controllability achieved by open loop stability enables the valve actuator assembly 10 to provide better performance. The valve actuator assembly 10 of the present invention precisely controls the motion of the second spool valve 62 through the feedback channels 72 and 74 so that it avoids unnecessary throttling of the low pressure flow and high pressure flow, thereby providing energy consumption benefit.

The present invention has been described in an illustrative manner. It is to be understood that the terminology, which has been used, is intended to be in the nature of words of description rather than of limitation.

Many modifications and variations of the present invention are possible in light of the above teachings. Therefore, within the scope of the appended claims, the present invention may be practiced other than as specifically described.

What is claimed is:

1. A method of operating a valve actuator assembly for a vehicle comprising:

providing a movable engine valve;

providing a first movable spool valve;

providing a second movable spool valve;

actuating an actuator operatively cooperating with the first spool valve and supplying an intermediate channel interconnecting the first spool valve and the second spool valve and a driving channel interconnecting the second spool valve and the engine valve with high pressure fluid to move open the engine valve;

supplying a first feedback channel interconnecting the second spool valve and the engine valve with fluid flow;

supplying a second feedback channel interconnecting the second spool valve and the engine valve with fluid flow;

enabling and disenabling the first feedback channel via a first on/off valve and enabling and disenabling the second feedback channel via a second on/off valve and controlling motion of the second spool valve.

2. A valve actuator assembly for an engine of a vehicle comprising:

a movable engine valve;

a movable first spool valve;

a movable second spool valve;

a driving channel interconnecting said second spool valve and said engine valve;

an intermediate channel interconnecting said first spool valve and said second spool valve;

a first feedback channel interconnecting said second spool valve and said engine valve;

a second feedback channel interconnecting said second spool valve and said engine valve;

an actuator operatively cooperating with said first spool valve to position said first spool valve to prevent and allow fluid flow in and out of said second spool valve and said driving channel to position said engine valve;

a first on/off valve in fluid communication with said first feedback channel to enable and disable said first feedback channel; and a second on/off valve in fluid communication with said second feedback channel to enable and disable said second feedback channel, whereby the first on/off valve and the second on/off valve control motion of the second spool valve.

3. A valve actuator assembly as set forth in claim 2 including a valve housing.

4. A valve actuator assembly as set forth in claim 3 wherein said valve housing has a first fluid chamber fluidly communicating with said driving channel and a second fluid chamber fluidly communicating with said first feedback channel.

5. A valve actuator assembly as set forth in claim 4 including a first piston operatively cooperating with said engine valve and being disposed in said valve housing and having said first fluid chamber on one side and said second fluid chamber on an opposite side.

6. A valve actuator assembly as set forth in claim 4 including a first on/off valve channel interconnecting said second fluid chamber and said first on/off valve.

7. A valve actuator assembly as set forth in claim 4 wherein said valve housing has a third fluid chamber fluidly communicating with said second feedback channel.

8. A valve actuator assembly as set forth in claim 7 including a second piston operatively cooperating with said engine valve and being disposed in said valve housing and having said third fluid chamber on one side thereof.

9. A valve actuator assembly as set forth in claim 8 including a second on/off valve channel interconnecting said third fluid chamber and said second on/off valve.

10. A valve actuator assembly as set forth in claim 2 including a fourth fluid chamber at one end of said second spool valve and fluidly communicating with said first feedback channel and a fifth fluid chamber at one end of said second spool valve opposite said fourth fluid chamber and fluidly communicating with said second feedback channel.

11. A valve actuator assembly as set forth in claim 10 including a first spool valve spring to bias said first spool valve toward said actuator.

12. A valve actuator assembly as set forth in claim 11 including a second spool valve spring to bias said second spool valve toward said fifth fluid chamber.

13. A valve actuator assembly as set forth in claim 12 including a third spool valve spring to bias said second spool valve toward said fourth fluid chamber.

14. A valve actuator assembly as set forth in claim 2 wherein said actuator is of a linear type to generate linear motion.

15. A valve actuator assembly as set forth in claim 14 including a controller electrically connected to said actuator to energize and de-energize said actuator.

16. A valve actuator assembly as set forth in claim 13 including a first on/off valve channel interconnecting said second fluid chamber and said first on/off valve.

17. A valve actuator assembly as set forth in claim 16 including a second on/off valve channel interconnecting said third fluid chamber and said second on/off valve.

18. A valve actuator assembly as set forth in claim 14 including a first spool valve spring to bias said first spool valve toward said actuator.

19. A valve actuator assembly as set forth in claim 18 including a second spool valve spring to bias said second spool valve toward said fifth fluid chamber.

20. A valve actuator assembly as set forth in claim 19 including a third spool valve spring to bias said second spool valve toward said fourth fluid chamber.

21. A valve actuator assembly comprising:

a movable engine valve;

a movable first spool valve;

a movable second spool valve;

a valve housing having a first fluid chamber, a second fluid chamber, and a third fluid chamber;

a first piston operatively cooperating with said engine valve and being disposed in said valve housing and having said first fluid chamber on one side and said second fluid chamber on an opposite side;

a second piston operatively cooperating with said engine valve and being disposed in said valve housing and having said third fluid chamber on one side thereof;

a driving channel interconnecting said second spool valve and said first fluid chamber;

an intermediate channel interconnecting said second spool valve and said first spool valve;

a first feedback channel interconnecting said second spool valve and said second fluid chamber;

a second feedback channel interconnecting said second spool valve and said third fluid chamber;

an actuator operatively cooperating with said first spool valve to position said first spool valve to prevent and allow fluid flow in and out of said second spool valve and said driving channel to position said engine valve;

a first on/off valve in fluid communication with said first feedback channel to enable and disable said first feedback-channel to stop said engine valve at a predetermined lift position; and a second on/off valve in fluid communication with said second feedback channel to enable and disable said second feedback channel to stop said engine valve at a predetermined return position.

22. A valve actuator assembly as set forth in claim 21 including a fourth fluid chamber at one end of said second spool valve and fluidly communicating with said first feedback channel and a fifth fluid chamber at one end of said second spool valve opposite said fourth fluid chamber and fluidly communicating with said second feedback channel.

23. A valve actuator assembly as set forth in claim 21 wherein said actuator is of a linear type to generate linear motion.

24. A valve actuator assembly as set forth in claim 23 including a controller electrically connected to said actuator to energize and de-energize said actuator.

* * * * *